US009533187B2

(12) United States Patent
Dalebout

(10) Patent No.: US 9,533,187 B2
(45) Date of Patent: Jan. 3, 2017

(54) CORE STRENGTHENING DEVICE

(71) Applicant: ICON Health & Fitness, Inc., Logan, UT (US)

(72) Inventor: William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 1 day.

(21) Appl. No.: 13/950,151

(22) Filed: Jul. 24, 2013

(65) Prior Publication Data

US 2014/0162858 A1 Jun. 12, 2014

Related U.S. Application Data

(60) Provisional application No. 61/675,477, filed on Jul. 25, 2012.

(51) Int. Cl.

| | |
|---|---|
| ***A63B 26/00*** | (2006.01) |
| ***A63B 23/02*** | (2006.01) |
| ***A63B 22/18*** | (2006.01) |
| ***A63B 23/12*** | (2006.01) |
| *A63B 69/00* | (2006.01) |
| *A63B 22/00* | (2006.01) |
| *A63B 22/02* | (2006.01) |
| *A63B 22/06* | (2006.01) |

(52) U.S. Cl.

CPC ..... *A63B 23/02* (2013.01); *A63B 22/0046* (2013.01); *A63B 22/18* (2013.01); *A63B 23/1236* (2013.01); *A63B 26/003* (2013.01); *A63B 22/0023* (2013.01); *A63B 22/02* (2013.01); *A63B 22/0605* (2013.01); *A63B 69/0093* (2013.01); *A63B 2208/0204* (2013.01); *A63B 2210/50* (2013.01); *A63B 2225/62* (2013.01)

(58) Field of Classification Search

CPC . A63B 22/0046; A63B 22/18; A63B 22/0023; A63B 23/02; A63B 23/1236; A63B 26/003; A63B 2208/0204; A63B 69/0093; A63B 2210/50; A63B 2225/62

See application file for complete search history.

(56) References Cited

U.S. PATENT DOCUMENTS

| | | | | |
|---|---|---|---|---|
| 4,801,140 | A * | 1/1989 | Bergeron | 482/146 |
| 5,292,297 | A * | 3/1994 | Hsu | 482/146 |
| 5,897,474 | A * | 4/1999 | Romero | 482/146 |
| 6,422,983 | B1 | 7/2002 | Weck | |
| 6,575,885 | B1 | 6/2003 | Weck et al. | |
| 6,702,726 | B2 * | 3/2004 | Lin | 482/148 |
| 6,872,175 | B2 * | 3/2005 | Lin | 482/146 |
| D517,136 | S * | 3/2006 | Chen | D21/688 |

(Continued)

*Primary Examiner* — Stephen Crow
*Assistant Examiner* — Gary D Urbiel Goldner
(74) *Attorney, Agent, or Firm* — Holland & Park LLP

(57) ABSTRACT

A core strengthening device includes a tray and a ball. The tray has first and second opposing sides. The first side of the tray has a recess formed therein. A ball is selectively positionable at least partially within the recess in the tray. The ball has a first hemisphere and a second hemisphere. The first hemisphere has a first radius and the second hemisphere has a second radius that is different than the first radius. The core strengthening device provides instability to exercises, which requires a user's core muscles to work harder to perform the exercises and maintain balance, which strengthens the user's core muscles.

16 Claims, 15 Drawing Sheets

(56) References Cited

U.S. PATENT DOCUMENTS

| | | | | |
|---|---|---|---|---|
| 7,300,392 | B1 * | 11/2007 | Curran | 482/146 |
| 7,341,545 | B2 | 3/2008 | Cao | |
| 7,344,488 | B2 | 3/2008 | Weck et al. | |
| 7,775,952 | B1 * | 8/2010 | Curran et al. | 482/146 |
| 8,734,308 | B1 * | 5/2014 | Joslin | 482/146 |
| 2004/0014571 | A1 * | 1/2004 | Haynes A63B | 21/0004 482/142 |
| 2004/0142801 | A1 * | 7/2004 | Lin | 482/142 |
| 2006/0217242 | A1 * | 9/2006 | Karpachev | 482/77 |
| 2008/0318743 | A1 * | 12/2008 | Bizzell et al. | 482/142 |
| 2012/0115691 | A1 * | 5/2012 | Munroe | 482/110 |
| 2013/0178346 | A1 * | 7/2013 | Lin | 482/146 |

* cited by examiner

CORE STRENGTHENING DEVICE

CROSS-REFERENCE TO RELATED APPLICATIONS

This application claims priority to U.S. Provisional Patent Application 61/675,477 filed on Jul. 25, 2012.

TECHNICAL FIELD

The present disclosure relates generally to systems, methods, and devices for strengthening core muscles and improving a person's balance. More particularly, the disclosure relates to kits, assemblies, and combinations of core strengthening and balance improving devices.

BACKGROUND

Using exercise balls (also known as stability or balance balls) has become a popular way to increase core strength, abdominal fitness, and balance. Exercising with an exercise ball, as opposed to exercising directly on a hard flat surface, forces the user's body to respond to the instability of the ball in order to remain balanced. As a result, the user engages many more muscles, which become stronger over time, thereby improving the user's balance, strength, and fitness. Most frequently, the core body muscles—the abdominal muscles and back muscles—are the focus of exercise ball fitness programs.

Depending on the type of exercise being performed or the fitness or skill level of the user, the level of instability of an exercise ball may need to be adjusted. The level of instability of an exercise ball can be decreased by reducing the pressure within the exercise ball so that the curvature of the exercise ball decreases (i.e., flattens out), making the exercise ball less prone to rolling. Conversely, the level of instability of an exercise ball can be increased by increasing the pressure within the exercise ball so that the curvature of the exercise ball increases, making the exercise ball more likely to roll. Typically, the pressure within an exercise ball can be adjusted by pumping air into or releasing air from the exercise ball through a valve.

Properly adjusting the level of instability of an exercise ball can be difficult. For instance, a pump may be required to increase the pressure within the exercise ball. Using the pump may be complicated and physically challenging for some users. Additionally, it can be difficult to achieve a level of pressure in the exercise ball that corresponds to a desired level of instability. For example, it may be difficult to gauge how much air to pump into or release from the exercise ball in order to achieve the desired level of instability. As a result, a user may pump too much or not enough air into the exercise ball to achieve the desired level of instability. Similarly, a user may release too much or not enough air from the exercise ball to achieve the desired level of instability.

Other exercise devices designed to improve a user's core strength and balance are disclosed in U.S. Pat. No. 6,422,983, U.S. Pat. No. 6,575,885, and U.S. Pat. No. 7,344,488.

SUMMARY OF THE INVENTION

In one aspect of the disclosure, a core strengthening device includes a tray and a ball. The tray has a first side and an opposing second side, with the first side having a recess formed therein. The ball is selectively positionable at least partially within the recess in the tray. The ball has a first hemisphere and a second hemisphere. The first hemisphere has a first radius and the second hemisphere has a second radius that is different than the first radius.

In another aspect that may be combined with any of the aspects herein, the recess in the tray has a predetermined depth and the ball has a height that is greater than the predetermined depth of the recess such that the ball projects out of the recess.

In another aspect that may be combined with any of the aspects herein, the second side of the tray includes a substantially flat surface.

In another aspect that may be combined with any of the aspects herein, the ball is selectively positionable within the recess such that either the first hemisphere is positioned closer to the second side of the tray than the second hemisphere or the second hemisphere is positioned closer to the second side of the tray than the first hemisphere.

In another aspect that may be combined with any of the aspects herein, the ball may be selectively inverted and positioned within the tray such that either the first hemisphere or the second hemisphere projects out of the recess.

In another aspect that may be combined with any of the aspects herein, the first hemisphere has an outer surface having tread thereon.

In another aspect that may be combined with any of the aspects herein, the first hemisphere has a shape that generally corresponds to a shape of the recess in the tray.

In another aspect that may be combined with any of the aspects herein, the core strengthening device is alternately usable in a first orientation and a second orientation.

In another aspect that may be combined with any of the aspects herein, when the core strengthening device is in the first orientation, the second side of the tray is positioned against a support surface and the ball projects out of the recess away from the support surface.

In another aspect that may be combined with any of the aspects herein, when the core strengthening device is in the second orientation, the second side of the tray faces away from the support surface and the ball projects out of the recess toward the support surface.

In another aspect that may be combined with any of the aspects herein, the first hemisphere and the second hemisphere of the ball may alternately project out of the recess toward the support surface when the core strengthening device is used in the second orientation.

In another aspect that may be combined with any of the aspects herein, the ball is usable to improve a user's core strength or balance independent from the tray.

In another aspect that may be combined with any of the aspects herein, the ball includes a valve to adjust a pressure level within the ball.

In another aspect that may be combined with any of the aspects herein, the first side of the tray includes multiple recesses formed therein.

In another aspect that may be combined with any of the aspects herein, the multiple recesses formed in the tray are generally aligned within a row.

In another aspect that may be combined with any of the aspects herein, the core strengthening device includes multiple balls selectively positionable at least partially within the multiple recesses of the tray.

In another aspect that may be combined with any of the aspects herein, one or more balls of the multiple balls has a first hemisphere and a second hemisphere, the first hemisphere having a first radius and the second hemisphere having a second radius that is different than the first radius.

In another aspect that may be combined with any of the aspects herein, a core strengthening device includes a tray having a first side and an opposing second side, the first side having a plurality of recesses formed therein.

In another aspect that may be combined with any of the aspects herein, the core strengthening device includes a plurality of balls selectively positionable at least partially within the plurality of recesses in the tray.

In another aspect that may be combined with any of the aspects herein, one or more balls of the plurality of balls has a first hemisphere and a second hemisphere, the first hemisphere having a first radius and the second hemisphere having a second radius that is different than the first radius.

In another aspect that may be combined with any of the aspects herein, the plurality of balls project out of the plurality of recesses.

In another aspect that may be combined with any of the aspects herein, the plurality of recesses are generally aligned in a row.

In another aspect that may be combined with any of the aspects herein, a core strengthening device includes a ball having a first hemisphere with an outer surface having a first radius.

In another aspect that may be combined with any of the aspects herein, the ball has a second hemisphere with an outer surface having a second radius, the second radius being greater than the first radius.

In another aspect that may be combined with any of the aspects herein, the ball includes a first pole, a second pole, and an equator.

In another aspect that may be combined with any of the aspects herein, the equator is positioned closer to the second pole than the first pole.

In another aspect that may be combined with any of the aspects herein, the tray includes a first portion, a second portion, and a hinge connecting the first and second portions.

In another aspect that may be combined with any of the aspects herein, the hinge enables the tray to be selectively moved between a use configuration and a storage configuration.

In another aspect that may be combined with any of the aspects herein, the tray includes a lock the selectively secures the tray in either a use configuration or a storage configuration.

In another aspect that may be combined with any of the aspects herein, one or more of the balls has a height that is equal to or greater than a depth of a recess in a tray.

In another aspect that may be combined with any of the aspects herein, one or more of the balls has first hemisphere with a first height and a second hemisphere with a second height.

In another aspect that may be combined with any of the aspects herein, a ball has a height that is greater than a depth of a recesses in a tray by a distance generally equal to a height of a first hemisphere or a second hemisphere of the ball.

In another aspect that may be combined with any of the aspects herein, a ball has a height that is greater than a depth of a recesses in a tray by a distance generally less than a height of a first hemisphere or a second hemisphere of the ball.

In another aspect that may be combined with any of the aspects herein, a ball has a height that is greater than a depth of a recesses in a tray by a distance generally greater than a height of a first hemisphere or a second hemisphere of the ball.

In another aspect that may be combined with any of the aspects herein, an exercise device includes a base support, an upright support structure, a pedal assembly, a seat, and a core strengthening device.

In another aspect that may be combined with any of the aspects herein, the upright support structure is mounted to the base support.

In another aspect that may be combined with any of the aspects herein, the upright support structure has a seat platform.

In another aspect that may be combined with any of the aspects herein, the pedal assembly is engagable and rotatable by a user's feet.

In another aspect that may be combined with any of the aspects herein, the pedal assembly is coupled to the upright support structure.

In another aspect that may be combined with any of the aspects herein, the seat is associated with the seat platform.

In another aspect that may be combined with any of the aspects herein, the core strengthening device is disposed between the seat and the seat platform.

In another aspect that may be combined with any of the aspects herein, the core strengthening device includes a tray disposed on the underside of the seat.

In another aspect that may be combined with any of the aspects herein, the tray has a recess formed therein.

In another aspect that may be combined with any of the aspects herein, the core strengthening device includes a ball positionable within the recess in the tray.

In another aspect that may be combined with any of the aspects herein, the ball extends partially out of the recess and is positionable upon the seat platform.

In another aspect that may be combined with any of the aspects herein, the exercise device includes a resistance assembly that provides resistance to the rotation of the pedal assembly.

In another aspect that may be combined with any of the aspects herein, the upright support structure is pivotally connected to the base support such that the upright support structure can pivot forward and backward relative to the base support.

In another aspect that may be combined with any of the aspects herein, the ball is selectively removable from the recess in the tray.

In another aspect that may be combined with any of the aspects herein, the tray may be selectively and stably positioned directly on the seat platform.

In another aspect that may be combined with any of the aspects herein, an exercise device includes a support structure, a treadbase, and one or more core strengthening devices.

In another aspect that may be combined with any of the aspects herein, the support structure includes a base support.

In another aspect that may be combined with any of the aspects herein, the treadbase is connected to the support structure.

In another aspect that may be combined with any of the aspects herein, the treadbase includes a rotatable belt upon which a user may walk, jog, or run.

In another aspect that may be combined with any of the aspects herein, the one or more core strengthening devices are positionable between the base support and a support surface.

In another aspect that may be combined with any of the aspects herein, at least one of the one or more core strengthening devices includes a tray disposed on the underside of the base support, the tray having a recess formed therein, and a ball positionable within the recess in the tray, wherein the ball extends partially out of the recess and is positionable against the support surface.

In another aspect that may be combined with any of the aspects herein, the exercise device includes one or more core strengthening devices positionable between the treadbase and the support surface.

In another aspect that may be combined with any of the aspects herein, the ball is selectively removable from the recess in the tray and the tray may be selectively and stably positioned directly on the support surface.

DETAILED DESCRIPTION

Figure 1:
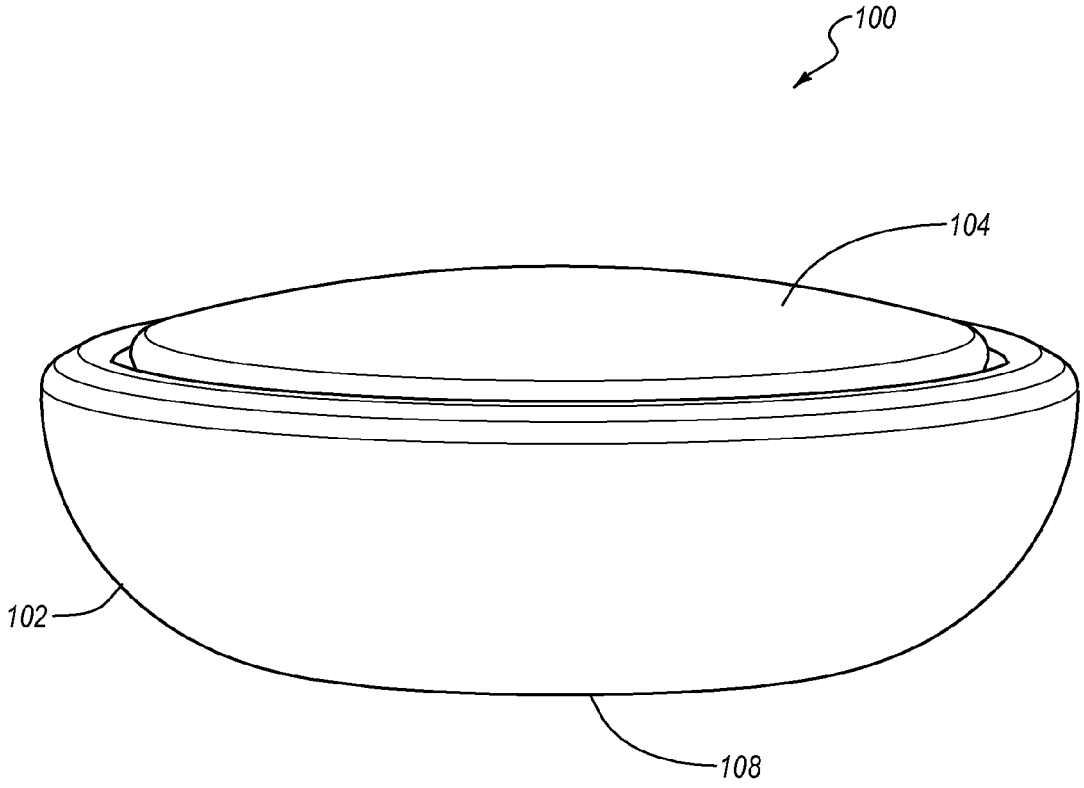
FIG. 1 illustrates a perspective view of a core strengthening device according to one implementation of the present invention.
Figure 2:
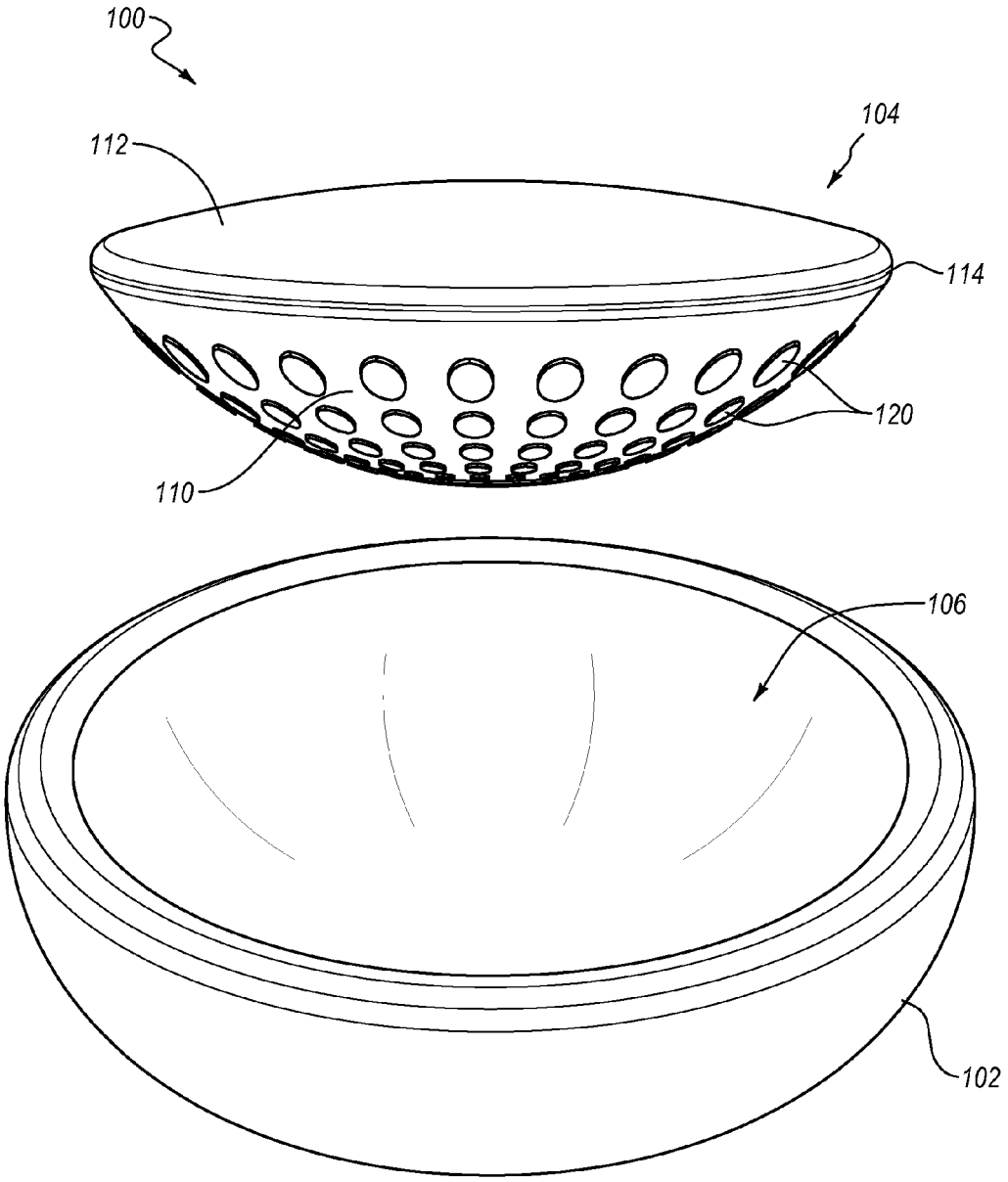
FIG. 2 illustrated an exploded view of the core strengthening device of FIG. 1.

The present invention is directed to core strengthening and balance improving devices, and particularly to kits, assemblies, and combinations of core strengthening and balance improving devices. FIGS. 1 and 2 illustrate one embodiment of a core strengthening/balance improving device 100. In the illustrated embodiment, device 100 includes a tray 102 and a ball 104. A user may use device 100 when performing various exercises to improve the user's core strength and balance. More specifically, ball 104 is somewhat malleable so that ball 104 at least slightly deforms when a force is applied thereto. As a result, when a user applies a force to device 100 during an exercise (i.e., standing on device 100 to do squats, leaning on device 100 to do pushups, etc.), ball 104 deforms, thereby providing some instability to the exercise. The instability provided by device 100 forces the user's muscles to work harder to maintain the user's balance, which strengthens the core muscles.

Tray 102 includes a first side that, as shown in FIG. 2, includes a recess 106 therein. Recess 106 is sized and configured to receive at least a portion of ball 104 therein, as shown in FIG. 1, for example. Tray 102 also includes an opposing second side that has a substantially flat surface 108. Flat surface 108 may be placed on a floor or other support surface during exercise and the user may engage ball 104. Alternatively, ball 104 may be placed against the floor or other support surface and the user may engage flat surface 108.

Figure 3:
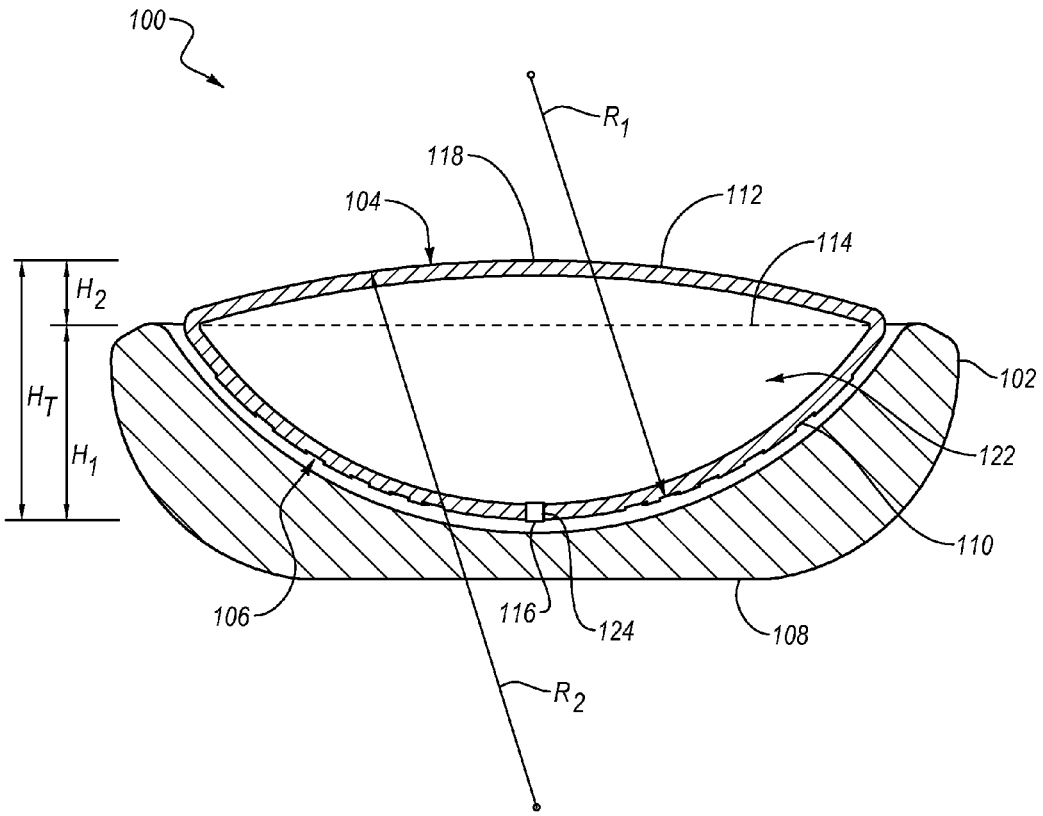
FIG. 3 illustrates a cross-sectional view of the core strengthening device of FIG. 1.

With continued attention to FIGS. 1 and 2, attention is now also directed to FIG. 3, which illustrates a cross-sectional view of device 100. As can be seen, ball 104 includes a first hemisphere 110 and a second hemisphere 112. First hemisphere 110 and second hemisphere 112 are separated by an equator 114. A first pole 116 is disposed at the apex of first hemisphere 110 and a second pole 118 is disposed at the apex of second hemisphere 112.

First hemisphere 110 has a first radius $R_1$ and second hemisphere 112 has a second radius $R_2$. As can be seen in the Figures, first radius $R_1$ is different than second radius $R_2$. More specifically, in the illustrated embodiment, first radius $R_1$ is less than second radius $R_2$. Ball 104 has a number of unique characteristics as a result of first radius $R_1$ and second radius $R_2$ being different from one another. For instance, the outer surface of first hemisphere 110 is more rounded than the outer surface of second hemisphere 112 and the outer surface of second hemisphere 112 is flatter than the outer surface of first hemisphere 110. Additionally, equator 114 is positioned closer to second pole 118 than first pole 116. Consequently, first hemisphere 110 has a height $H_1$ that is greater than a height $H_2$ of second hemisphere 112.

As can be seen in FIG. 3, the height $H_1$ of first hemisphere 110 is generally about equal to the depth of recess 106. As a result, when ball 104 is positioned within recess 106 as shown in FIG. 3 (i.e., with first hemisphere 110 facing and positioned within recess 106 so that first hemisphere 110 is closer to flat surface 108 than second hemisphere 112), second hemisphere 112 projects out of recess 106 to a height above the top of recess 106 that is generally equal to about the height $H_2$ of second hemisphere 112. In other words, the total height $H_T$ of ball 104 (i.e., height $H_1$ plus height $H_2$) is greater than the depth of recess 106 by a distance generally equal to height $H_2$. It is understood, however, that the depth of recess 106 may be greater or less than height $H_1$. For instance, the depth of recess 106 may be about equal to height $H_2$, similar to recesses 156 discussed below. Alternatively, the depth of recess 106 may be less than height $H_2$, between height $H_1$ and height $H_2$, or greater than height $H_2$.

As can also be seen in FIG. 3, the shape of the outer surface of first hemisphere 110 generally corresponds to the shape of recess 106. The outer surface of first hemisphere 110 may be generally smooth or, as illustrated in FIG. 2, may include contours, tread patterns, or other features 120 that provide or improve friction between ball 104 and tray 102. The contours, tread patterns, or other features may take any number of different forms. For instance, the contours, tread patterns, or other features may include ridges that extend circumferentially or helically about the outer surface of first hemisphere 110. In other embodiments, such as that shown in FIG. 2, the contours may include dimples, bumps, or any combination of different contours, tread patterns, or other features whether in regular or irregular patterns. Although not illustrated, recess 106 may include contours, tread patterns, or other features that generally correspond to the contours, tread patterns, or other features 120 of first hemisphere 110.

Figure 4:
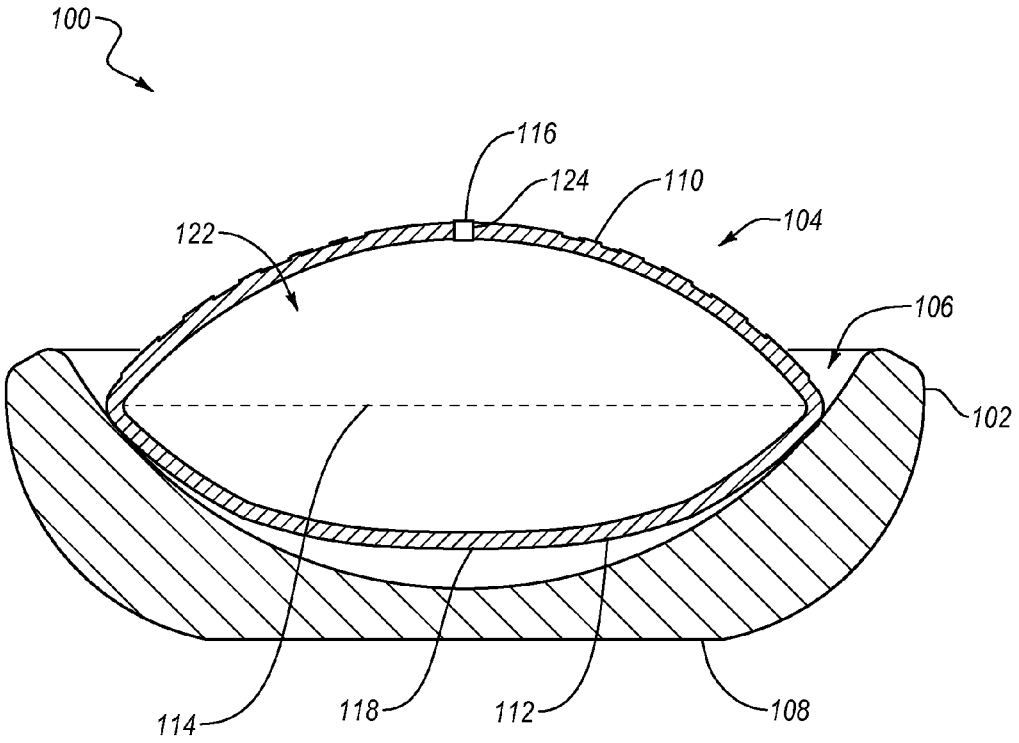
FIG. 4 illustrates another cross-sectional view of the core strengthening device of FIG. 1.

In addition to positioning ball 104 in recess 106 as shown in FIG. 3 (i.e., with first hemisphere 110 facing and positioned within recess 106 so that first hemisphere 110 is closer to flat surface 108 than second hemisphere 112), ball 104 may be selectively removed from recess 106, inverted, and positioned within recess 106 as shown in FIG. 4. As shown in FIG. 4, ball 104 is positioned within recess 106 such that second hemisphere 112 faces and is positioned within recess 106 so that second hemisphere 112 is closer to flat surface 108 than first hemisphere 110. When ball 104 is so positioned within recess 106, second hemisphere 112 may at least partially deform so that at least a portion of the outer surface of second hemisphere 112 generally conforms to the shape of recess 106. Nevertheless, as shown in FIG. 4, ball 104, and particularly first hemisphere 110, projects out of recess 106 to a height above the top of recess 106.

As shown in FIGS. 3 and 4, ball 104 may optionally be formed with an interior chamber 122 that may be pressurized with a gas, such as air, or a fluid. In some cases, it may be desirable to adjust the level of pressure within interior chamber 122. Accordingly, ball 104 may include a valve 124 that enable the selective adjustment of the pressure within interior chamber 122. For instance, valve 124 may allow for additional gas or fluid to be pumped into interior chamber 122 to increase the pressure therein. Similarly, valve 124 may allow for gas or fluid to be removed from interior chamber 122 to decrease the pressure therein.

Figure 5A:
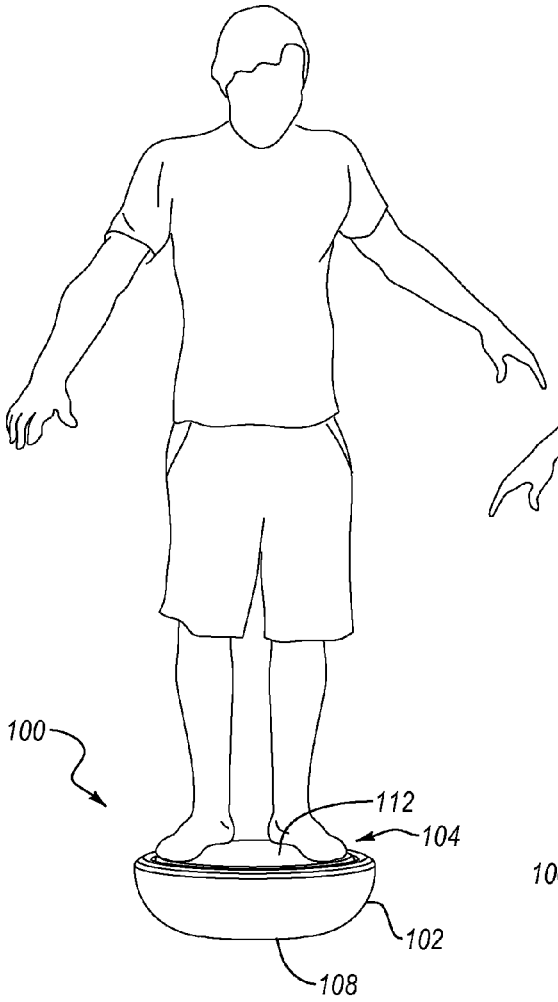
FIGS. 5A-5F illustrate example uses of the core strengthening device of FIG. 1.
Figure 5B:
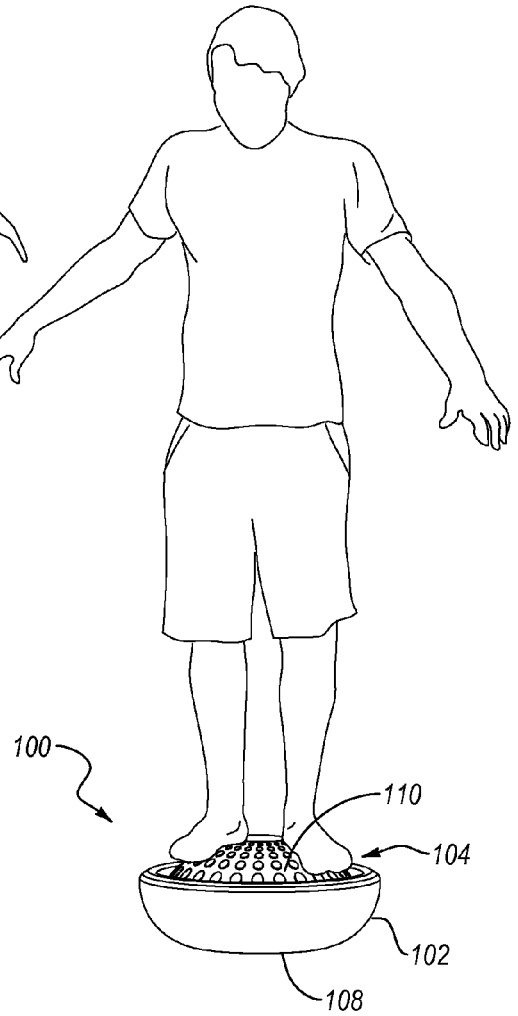

FIGS. 5A-5F illustrate various manners in which device 100 may be used. FIGS. 5A-5B illustrate device 100 being used in a first orientation. In the first orientation, the second side (i.e., flat surface 108) of tray 102 is positioned against a support surface and ball 104 projects out of recess 106 away from the support surface. As can be seen in FIG. 5A, ball 104 may be positioned within tray 102 so that second hemisphere 112 projects out of recess 106 and away from the support surface. Similarly, as shown in FIG. 5B, ball 104 may be positioned within tray 102 so that first hemisphere 110 projects out of recess 106 and away from the support surface. In the illustrated embodiments of device 100 being used in the first orientation, the user engages ball 104.

Figure 5C:
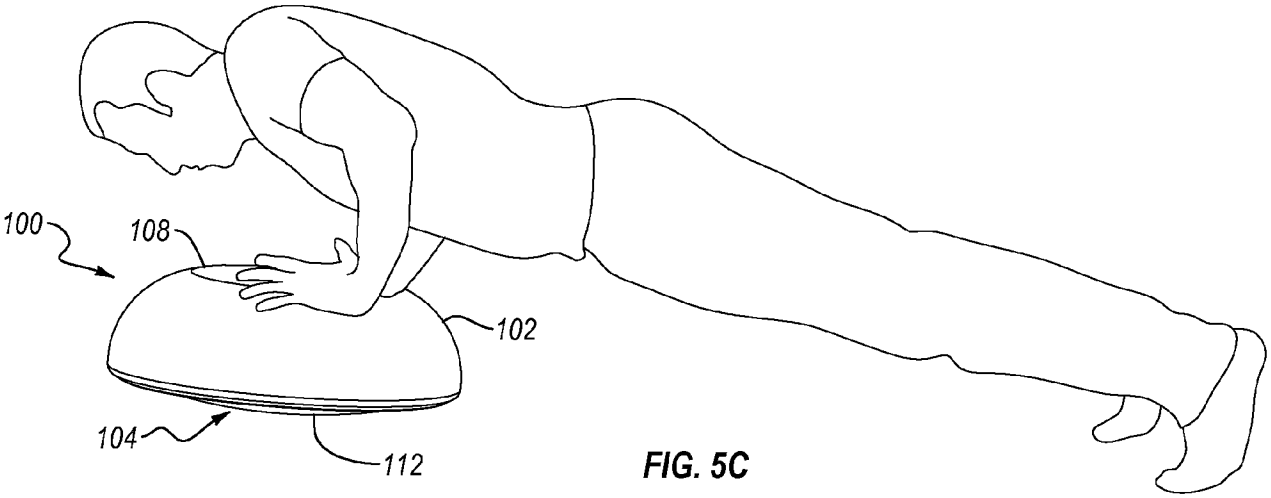
Figure 5D:
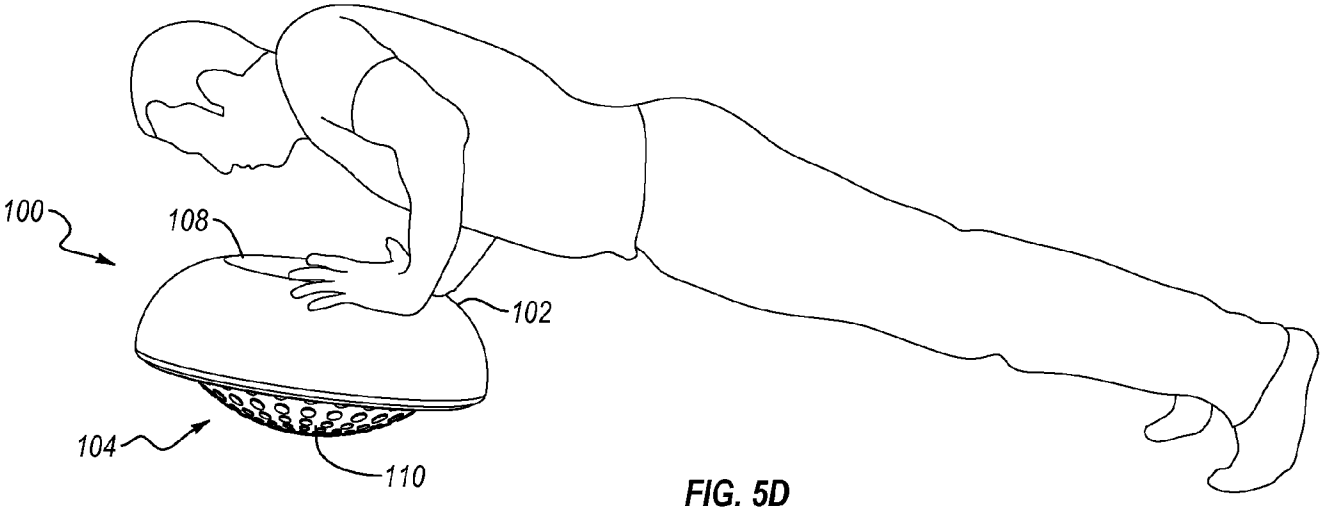

FIGS. 5C-5D illustrate device 100 being used in a second orientation. In the second orientation, the second side (i.e., flat surface 108) of tray 102 faces away from a support surface and ball 104 projects out of recess 106 toward the support surface. As can be seen in FIG. 5C, ball 104 may be positioned within tray 102 so that second hemisphere 112 projects out of recess 106 and toward the support surface. Similarly, as shown in FIG. 5D, ball 104 may be positioned within tray 102 so that first hemisphere 110 projects out of recess 106 and toward the support surface. In the illustrated embodiments of device 100 being used in the second orientation, the user engages flat surface 108.

Figure 5E:
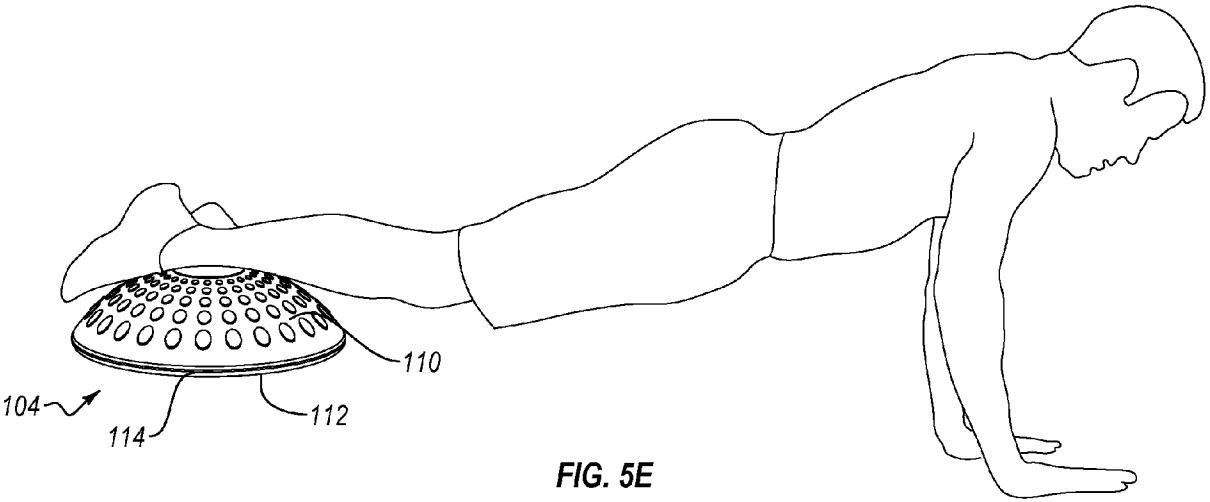
Figure 5F:
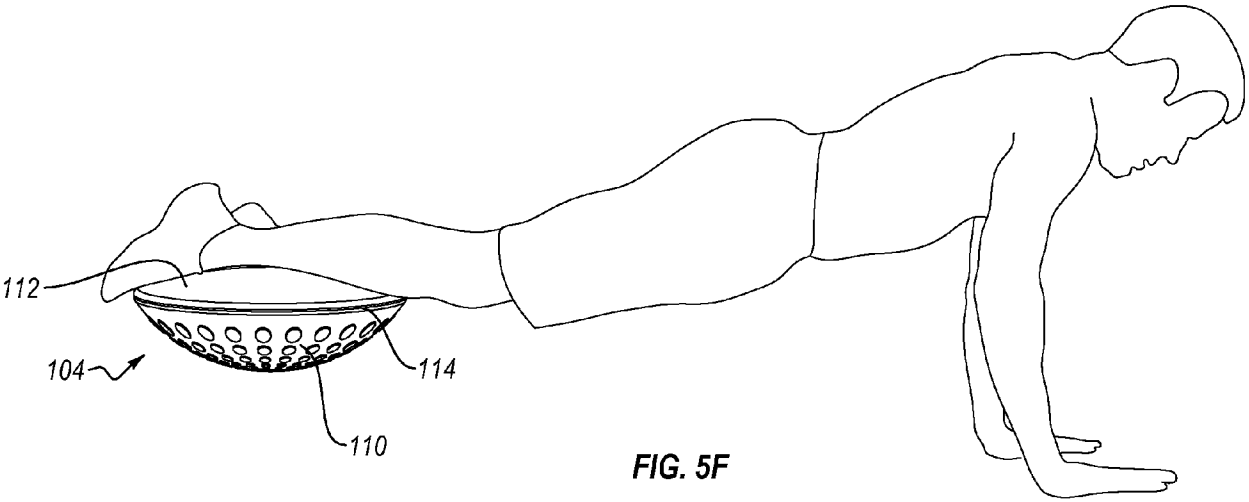

As shown in FIGS. 5E-5F, ball 104 may be used independent of tray 102. More specifically, ball 104 may be selectively removed from tray 102 and used to perform various exercises without tray 102. As can be seen in FIG. 5E, for example, ball 104 may be positioned on a support surface such that second hemisphere 112 engages the support surface. The user may engage the first hemisphere 110 when performing various exercises. Alternatively, as shown in FIG. 5F, ball 104 may be positioned on a support surface such that first hemisphere 110 engages the support surface. In this arrangement, the user may engage the second hemisphere 112 when performing various exercises.

Attention is now directed to FIGS. 6-11, which illustrate a device 150 according to another embodiment of the present invention. Device 150 is similar to device 100 in many respects. For instance, device 150 includes a tray 152 that may rest against a support surface or be engaged by a user during the performance of various exercises. Unlike device 100 that has a single ball 104, device 150 includes a plurality of balls 154. Balls 154 may be somewhat malleable so that balls 154 at least slightly deform when a force is applied thereto. As a result, when a user applies a force to device 150 during an exercise (i.e., standing on device 150 to do squats, leaning on device 150 to do pushups, etc.), balls 154 deforms, thereby providing some instability to the exercise. The instability provided by device 150 forces the user's muscles to work harder to maintain the user's balance, which strengthens the user's core muscles.

Figure 6:
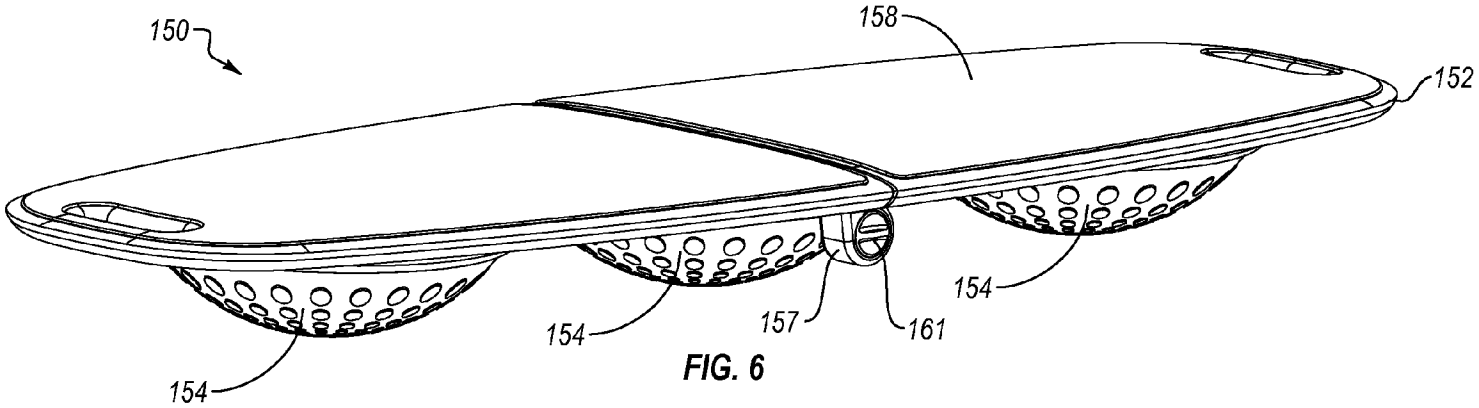
FIG. 6 illustrates a perspective view of a core strengthening device according to another embodiment of the present invention.
Figure 7:
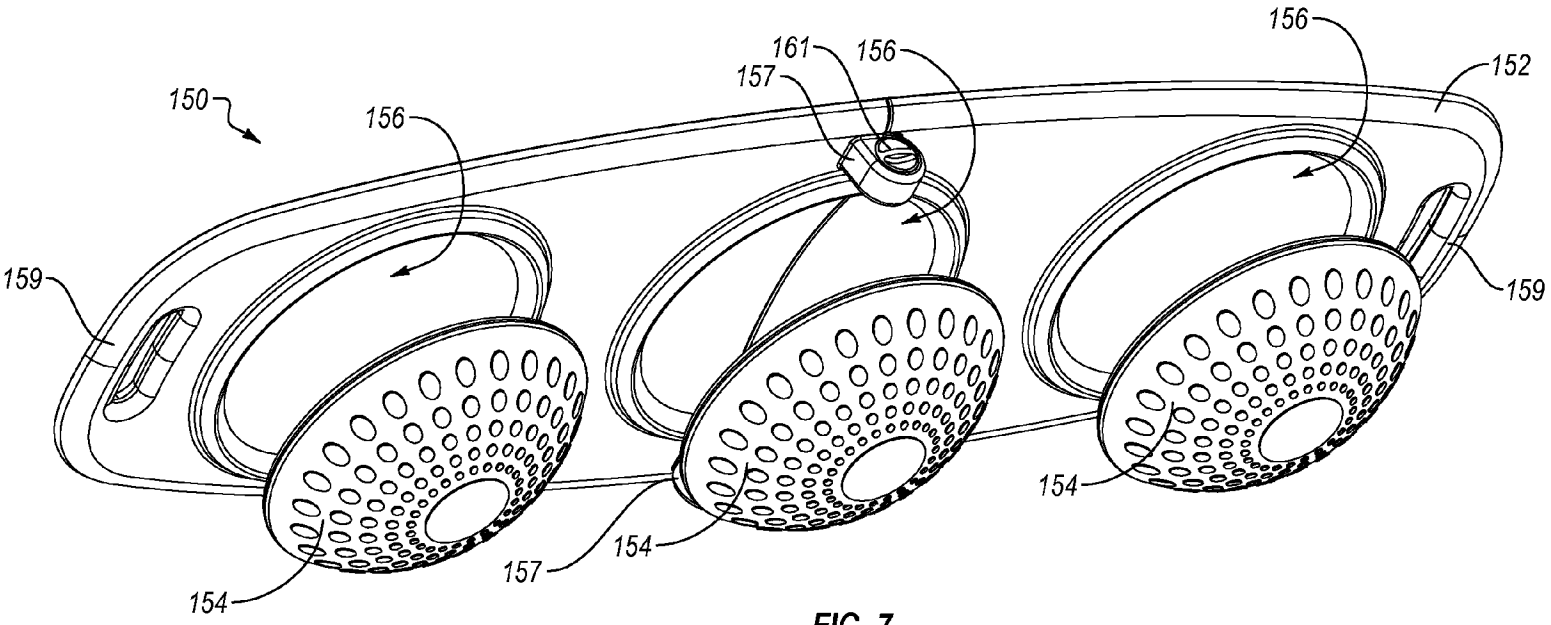
FIG. 7 illustrated an exploded perspective view of the core strengthening device of FIG. 6.

Tray 152, which has a shape similarly to a surf or paddle board, includes a first side that, as shown in FIG. 7, includes multiple recesses 156 therein. Recesses 156 are each sized and configured to receive at least a portion of a ball 154 therein, as shown in FIG. 6, for example. In the illustrated embodiment, recesses 156 are generally aligned with one another in a row along the length of tray 152. In other embodiments, however, recesses 156 may be arranged in configurations other than a row.

Tray 152 also includes an opposing second side that has a substantially flat surface 158. Flat surface 158 may be placed on a floor or other support surface during exercise and the user may engage one or more of balls 154. Alternatively, balls 154 may be placed against the floor or other support surface and the user may engage flat surface 158. Optionally, tray 152 may include one or more handles 159. As discussed in greater detail below, tray 152 may also optionally include a hinge 157 that allows tray 152 to be folded for storage.

Figure 8:
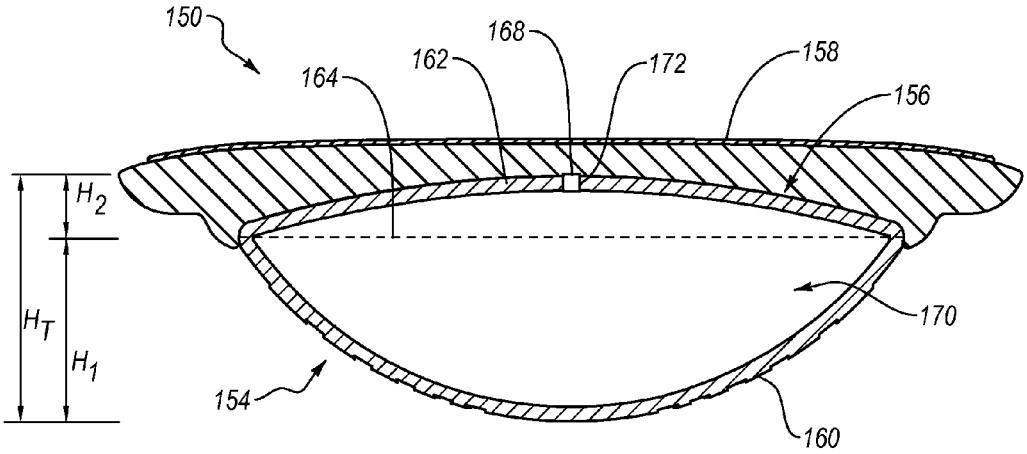
FIG. 8 illustrates a cross-sectional view of the core strengthening device of FIG. 6.

With continued attention to FIGS. 6 and 7, attention is now also directed to FIG. 8, which illustrates a cross-sectional view of device 150. More specifically, FIG. 8 illustrates a cross-sectional view of device 150 showing one of balls 154 positioned within one of recesses 156. Balls 154 may be similar or identical to ball 104. For instance, as can be seen in FIG. 6, ball 154 includes a first hemisphere 160 and a second hemisphere 162. First hemisphere 160 and second hemisphere 162 are separated by an equator 164. A first pole 166 is disposed at the apex of first hemisphere 160 and a second pole 168 is disposed at the apex of second hemisphere 162.

Like ball 104, first hemisphere 160 of ball 154 has a first radius $R_1$ and second hemisphere 162 has a second radius $R_2$. As with the previous embodiment, first radius $R_1$ is different than second radius $R_2$. More specifically, in the illustrated embodiment, first radius $R_1$ is less than second radius $R_2$. Balls 154 have a number of unique characteristics as a result of first radius $R_1$ and second radius $R_2$ being different from one another. For instance, the outer surface of first hemisphere 160 is more rounded than the outer surface of second hemisphere 162 and the outer surface of second hemisphere 162 is flatter than the outer surface of first hemisphere 160. Additionally, equator 164 is positioned closer to second pole 168 than first pole 166. Consequently, first hemisphere 160 has a height $H_1$ that is greater than a height $H_2$ of second hemisphere 162.

As can be seen in FIG. 8, the height $H_2$ of second hemisphere 166 is generally about equal to the depth of recess 156. As a result, when ball 154 is positioned within recess 156 as shown in FIG. 8 (i.e., when second hemisphere 162 faces and is positioned within recess 156 so that second hemisphere 162 is closer to flat surface 158 than first hemisphere 160), first hemisphere 160 projects out of recess 156 a distance that is generally equal to about the height $H_1$ of first hemisphere 160. In other words, the total height $H_T$ of balls 154 (i.e., height $H_1$ plus height $H_2$) is greater than the depth of recess 156 by a distance generally equal to about height $H_1$. It is understood, however, that the depth of recesses 156 may be greater or less than height $H_2$. For instance, the depth of recesses 156 may be about equal to height $H_1$, similar to recess 106 discussed above. Alternatively, the depth of recesses 156 may be less than height $H_2$, between height $H_1$ and height $H_2$, or greater than height $H_2$.

As can also be seen in FIG. 8, the shape of the outer surface of second hemisphere 162 generally corresponds to the shape of recess 156. The outer surface of second hemisphere 162 may be generally smooth or may include contours, tread patterns, or other features that provide or improve friction between balls 154 and tray 152. Similarly, as shown in FIGS. 6-7, first hemisphere 160 may include contours, tread patterns, or other features that provide or improve friction between balls 154 and either tray 152 or a support surface. The contours, tread patterns, or other features may take any number of different forms. For instance, the contours, tread patterns, or other features may include ridges that extend circumferentially or helically about the outer surface of balls 154. In other embodiments, such as that shown in FIGS. 6-7, the contours may include dimples, bumps, or any combination of different contours, tread patterns, or other features whether in regular or irregular patterns. Although not illustrated, recesses 156 may optionally include contours, tread patterns, or other features that may or may not generally correspond to the contours, tread patterns, or other features of balls 156.

Figure 9:
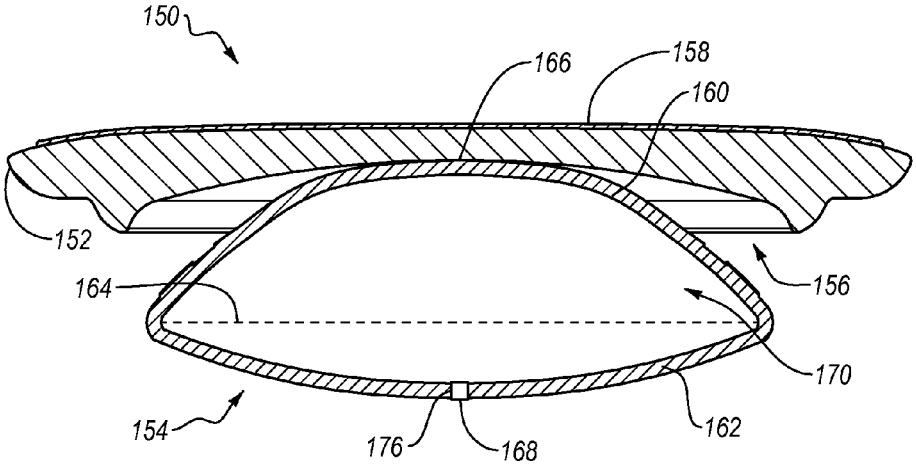
FIG. 9 illustrates another cross-sectional view of the core strengthening device of FIG. 6.

In addition to positioning balls 154 in recesses 156 as shown in FIG. 8 (i.e., with second hemisphere 162 facing and positioned within recess 156 so that second hemisphere 162 is closer to flat surface 158 than first hemisphere 160), balls 154 may be selectively removed from recesses 156, inverted, and positioned within recesses 156 as shown in FIG. 9. As shown in FIG. 9, ball 154 is positioned within recess 156 such that first hemisphere 160 faces and is positioned within recess 156 so that first hemisphere 160 is closer to flat surface 158 than second hemisphere 162. When ball 154 is so positioned within recess 156, first hemisphere 160 may at least partially deform so that at least a portion of the outer surface of first hemisphere 160 generally conforms to the shape of recess 156. Nevertheless, as shown in FIG. 9, ball 154, including second hemisphere 162 and a portion of first hemisphere 160, projects a distance out of recess 156.

Like ball 104, and as shown in FIGS. 8 and 9, balls 154 may optionally be formed with an interior chamber 170 that may be pressurized with a gas, such as air, or a fluid. In some cases, it may be desirable to adjust the level of pressure within interior chamber 170. Accordingly, each of balls 154 may include a valve 172 that enable the selective adjustment of the pressure within interior chambers 170. For instance, valve 172 may allow for additional gas or fluid to be pumped into interior chamber 170 to increase the pressure therein. Similarly, valve 172 may allow for gas or fluid to be removed from interior chamber 170 to decrease the pressure therein.

Figure 10B:
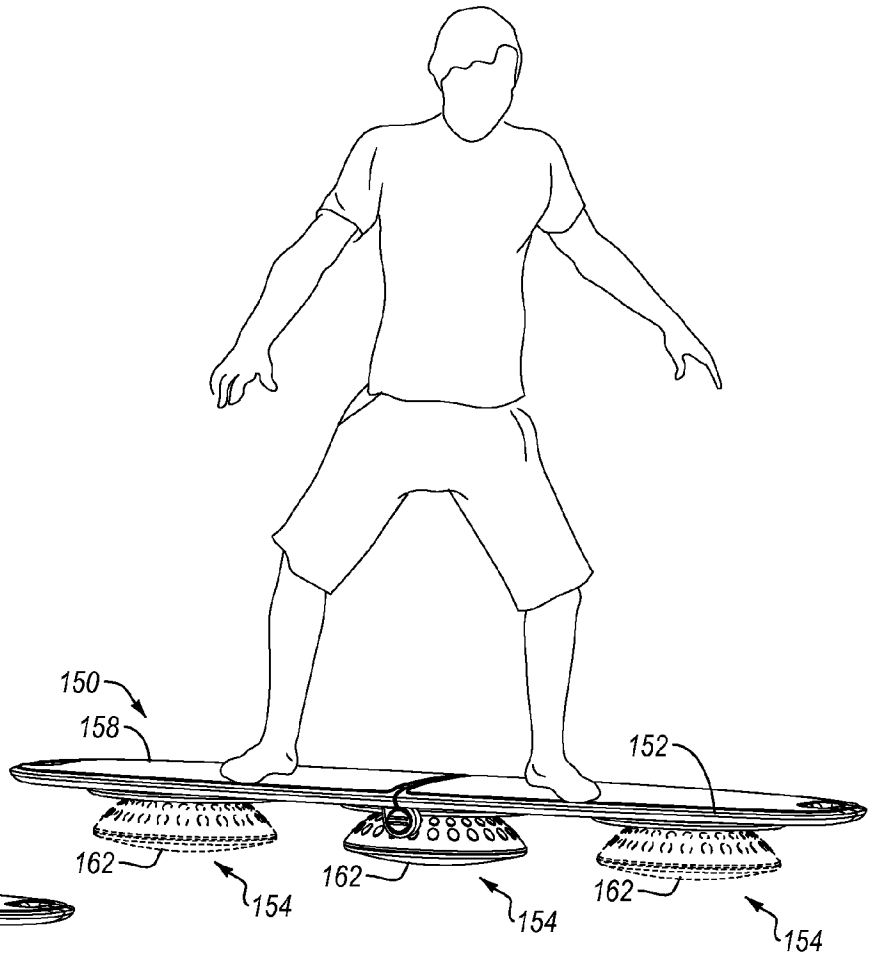
FIGS. 10A-10F illustrate example uses of the core strengthening device of FIG. 6.
Figure 10A:
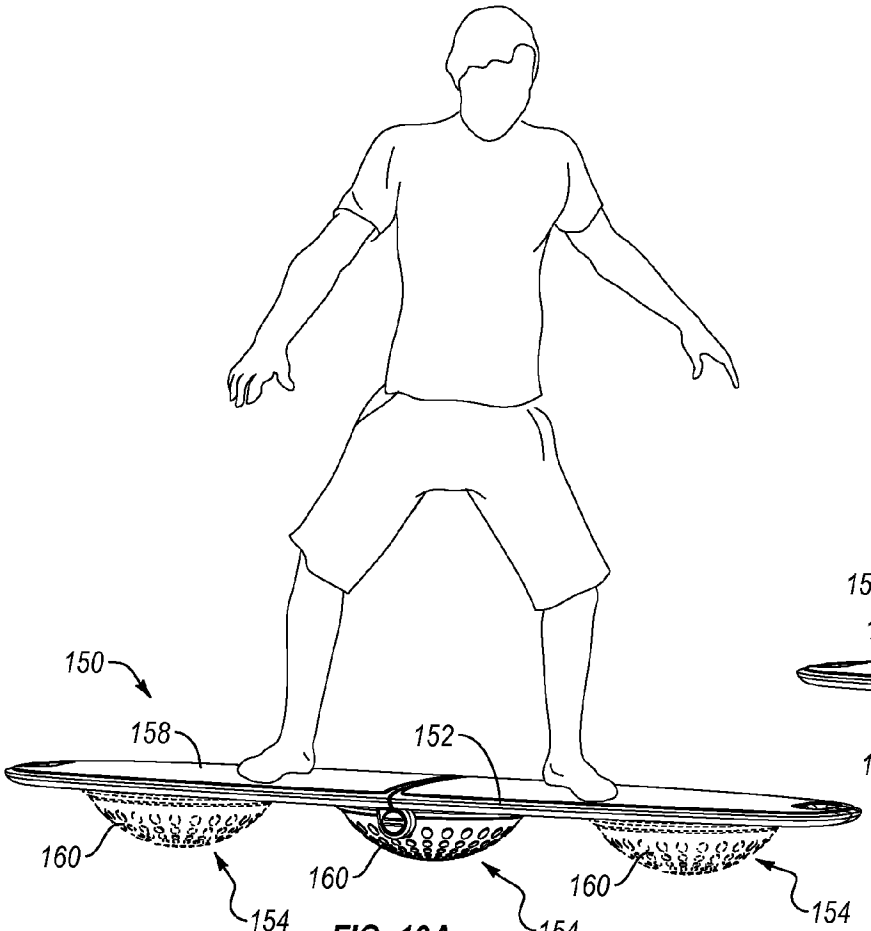

FIGS. 10A-10F illustrate various manners in which device 150 may be used. FIGS. 10A-10B illustrate device 150 being used in a first orientation. In the first orientation, the second side (i.e., flat surface 18) of tray 152 is positioned facing away from a support surface and balls 154 project out of recesses 156 toward the support surface such that balls 154 rest against the support surface. As can be seen in FIG. 10A, balls 154 may be positioned within tray 152 so that first hemispheres 160 project out of recesses 156 and toward the support surface. Similarly, as shown in FIG. 10B, balls 154 may be positioned within tray 152 so that second hemispheres 162 project out of recess 156 and toward the support surface. In the illustrated embodiments of device 150 being used in the first orientation, the user engages flat surface 158 of tray 152.

As can be seen in FIGS. 10A-10B, two of balls 154 are shown in dashed lines, indicating that not all of balls 154 are required to be used at any given time. For instance, a user may use device 150 with only a single ball 154 positioned within one of recesses 156. In FIGS. 10A-10B, for example, the middle ball 154 (shown in solid lines) may be positioned in the middle recess 156 and the balls 154 shown in dashed lines may be removed from recesses 156. Using a single ball 154 allows for tray 152 to tilt in both lateral directions and in the fore and aft directions. As a result, greater instability is provided in all directions.

Alternatively, two or more of balls 154 may be positioned within two or more of recesses 156 when performing various exercises. In FIGS. 10A-10B, for example, two or more of balls 154 may be positioned in recesses 156. Using multiple balls 154 limits tray 152 from tilting in the lateral directions, but still allows tray 152 to tilt in the fore and aft directions. As a result, instability is still provided, although to a lesser degree. In light of the foregoing, it will be understood that using different numbers of balls 154, and arranging balls 154 in different combinations in recesses 156, provides greater versatility in exercise options when using device 150.

Figure 10D:
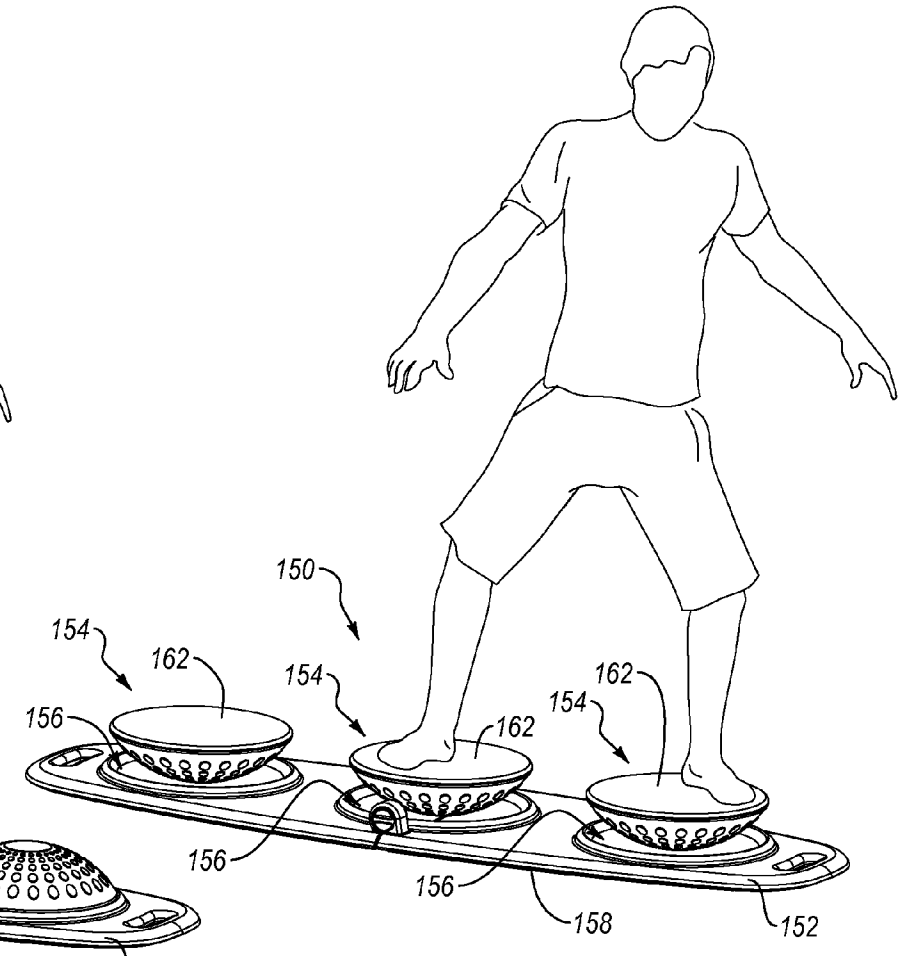
Figure 10C:
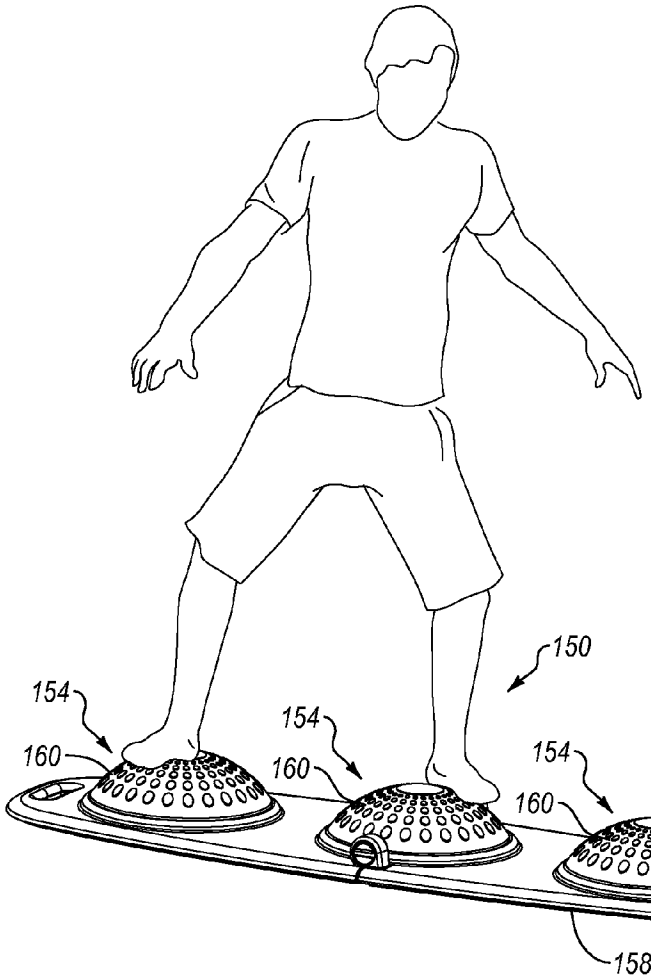

FIGS. 10C-10D illustrate device 150 being used in a second orientation. In the second orientation, the second side (i.e., flat surface 158) of tray 152 faces toward a support surface and balls 154 project out of recess 156 away from the support surface. As can be seen in FIG. 10C, one or more of balls 154 may be positioned within tray 152 so that first hemispheres 160 project out of recesses 156 and away from the support surface. Similarly, as shown in FIG. 10D, one or more of balls 154 may be positioned within tray 152 so that second hemispheres 162 project out of recesses 156 and away from the support surface. In the illustrated embodiments of device 150 being used in the second orientation, the user engages one or more of balls 154 while flat surface 108 rests against the support surface.

Figures 10E, 10F:
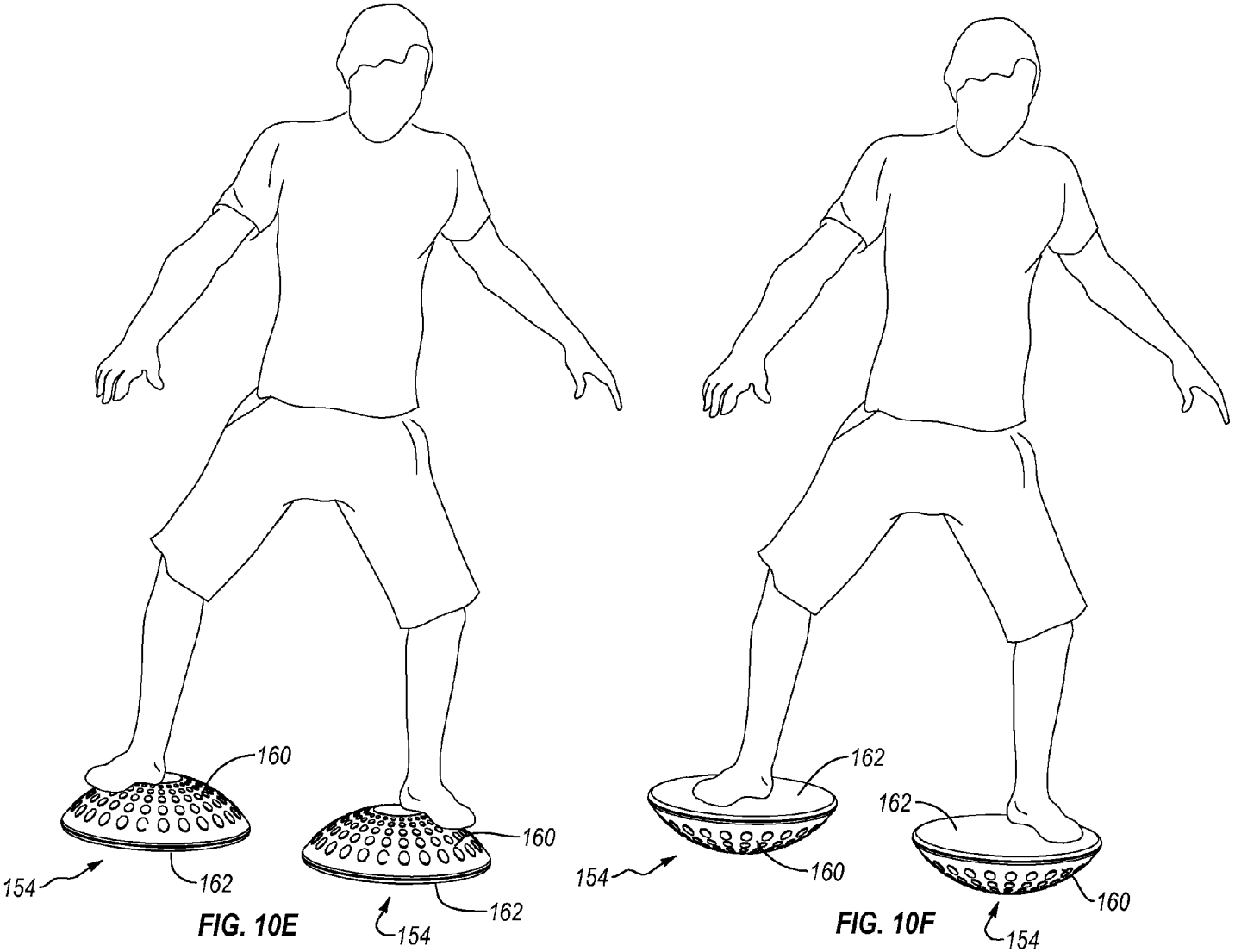

As shown in FIGS. 10E-10F, one or more of balls 154 may be used independent of tray 152. More specifically, one or more of balls 154 may be selectively removed from tray 152 and used to perform various exercises without tray 152. As can be seen in FIG. 10E, for example, two of balls 154 may be positioned on a support surface such that second hemispheres 162 engage the support surface. The user may engage first hemispheres 160 when performing various exercises. Alternatively, as shown in FIG. 10F, one or more of balls 154 may be positioned on a support surface such that first hemispheres 160 engages the support surface. In this arrangement, the user may engage second hemispheres 162 when performing various exercises.

Figure 11:
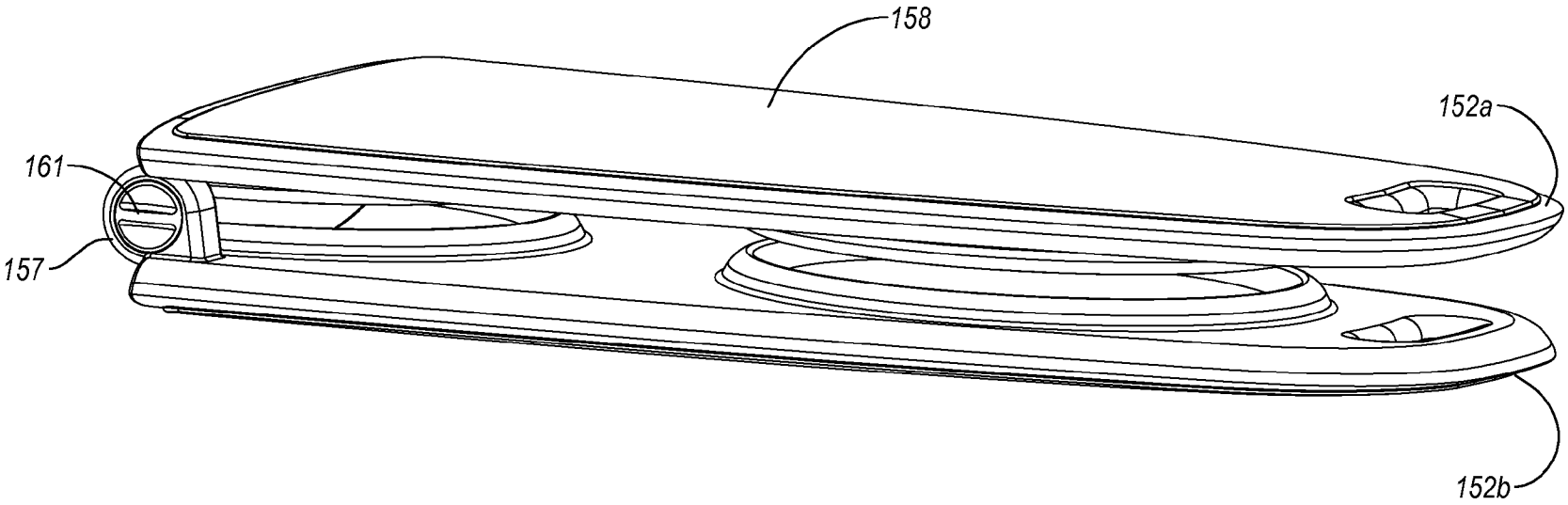
FIG. 11 illustrates a tray of the core strengthening device of FIG. 6 in a folded or storage configuration.

As noted above, tray 152 may optionally include one or more hinges 157 that allows tray 152 to be folded for storage. As shown in FIG. 11, tray 152 may include a first portion **152*a* and a second portion 152*b* that are connected together with one or more hinges 157. First portion 152*a* and/or second portion 152*b* may pivot about hinges 157 so that tray 152 is folded into the storage configuration shown in FIG. 11. As can be seen, when tray 152 is in the folded configuration, the recesses 156 on first portion 152*a* face and are disposed adjacent to the recesses 156 on second portion 152*b*. Hinges 157 thus allows tray 152** to be folded into a more compact configuration for storage.

In addition to hinges 157, tray 152 may also include one or more locking mechanism that selectively secures tray 152 in either the use configuration shown in FIGS. 6-7 or the storage configuration shown in FIG. 11. In the presently illustrated embodiment, at least one of hinges 157 includes a lock 161 that may selectively secure tray 152 is one or more configurations. For instance, once tray 152 has been arranged in the use configuration shown in FIGS. 6-7, lock 161 may be activated to selectively secure tray 152 in the use configuration. When it is desired to store tray 152, lock 161 may be deactivated or released to allow first portion 152*a* and/or second portion 152*b* to be folded towards one another and about hinges 157. Once tray 152 is folded, lock 161 may be activated to selectively secure tray 152 in the storage configuration.

Figure 12:
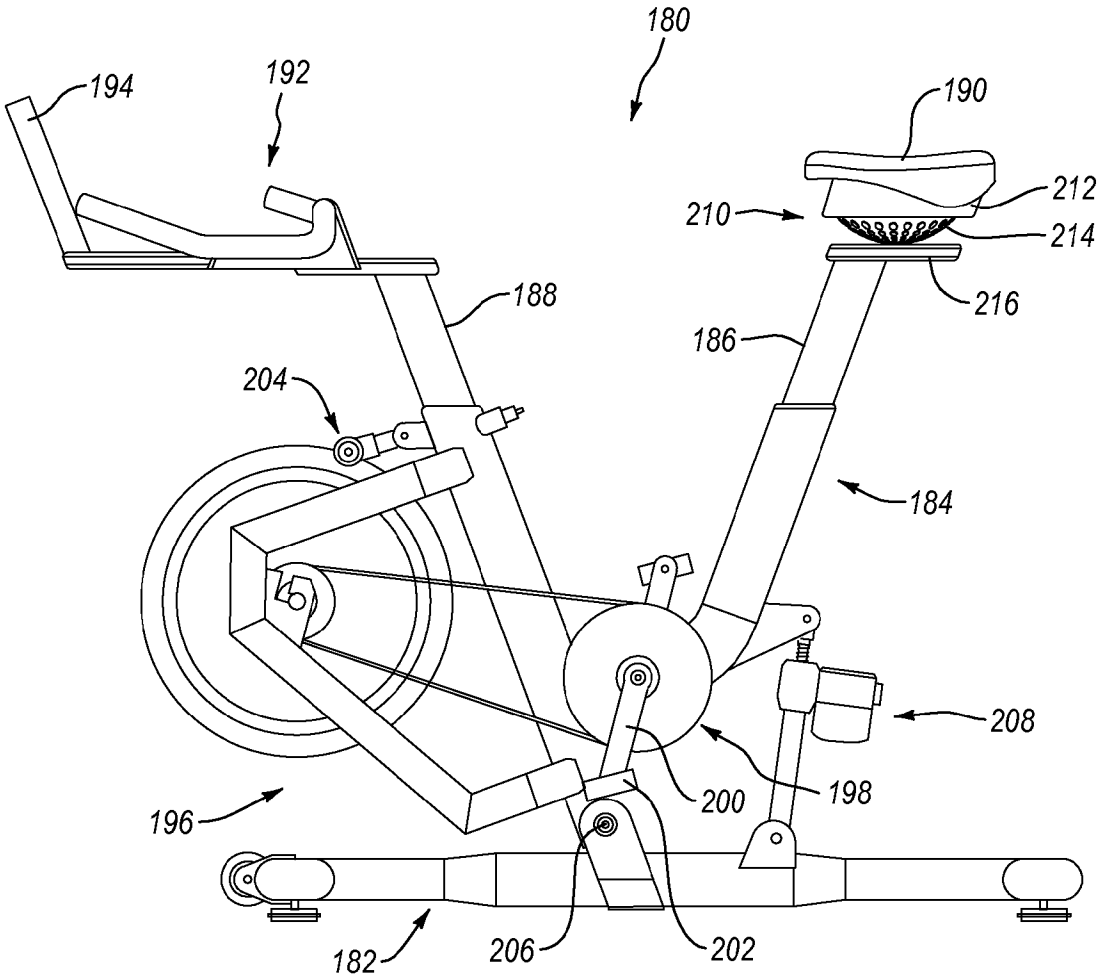
FIG. 12 illustrates a stationary exercise cycle that has a core strengthening device incorporated therein.

Attention is now directed to FIG. 12, which illustrates an exercise device 180 in the form of a stationary exercise cycle. Exercise device 180 includes a base support 182 and a generally upright support structure 184 pivotally connected thereto. Upright support structure 184, in this illustrative embodiment, includes two support members 186, 188. Disposed on an upper end of support member 186 is a seat 190 upon which a user may sit when exercising on exercise device 180. Support member 188 includes a handlebar assembly 192 and a control panel 194.

A drive assembly 196 is mounted on upright support structure 184. Drive assembly 196 includes a rotatable pedal assembly 198 that includes a pair of cranks 200 and pedals 202. Drive assembly 196 also includes a resistance assembly 204 for providing resistance to the rotation of pedal assembly 198.

As noted, upright support structure 184 is pivotally connected to base support 182. More specifically, upright support structure 184 is pivotally connected to base support 182 at pivot 206, which may allow upright support structure 184 to pivot forward, backward, and/or side-to-side. To facilitate the tilting of upright support structure 184 relative to base support 182, an extension mechanism 208, or another linearly extending assembly, may be connected between upright support structure 184 and base support 182, as shown in FIG. 12. Extension mechanism 208 may extend or retract to tilt upright support structure 184 forward or backward as desired.

Additionally, exercise device 180 includes a core strengthening device 210. Core strengthening device 210 is similar in many respects to device 100 discussed above. More specifically, device 210 includes a tray 212 disposed on the underside of seat 190. Tray 212 has a recess formed in a bottom surface thereof, similar to recesses 156 in tray 152. A ball 214 can be positioned at least partially within and extend at least partially out of the recess in tray 212. Ball 214 can be similar or identical to balls 104, 154 described above. The portion of ball 214 that extends out of tray 212 may rest on a seat platform 216 on support member 186. Device 210 provides some instability to seat 190 such that seat 190 can rock is various directions as a user sits thereon. As a result, the user's core muscles will have to work harder to maintain the user's balance, thereby improving the user's core strength.

In some embodiments, ball 214 may be removed from the recess in tray 212 and tray 212 may be positioned directly on seat platform 216. The recess in tray 212 and seat platform 216 may be shaped or otherwise configured so that seat 190 is maintained in a relatively stable position when tray 212 is placed directly on seat platform 216. Thus, a user may select to have ball 214 positioned between seat 190 and support member 186 to enhance a core muscle workout, or the user may select to remove ball 214 and have a stable seat 190. Additionally, the height of support member 186 may be selectively adjustable to allow for seat 190 to be raised or lowered depending on whether ball 214 is positioned between tray 212 and seat platform 216.

Figure 13:
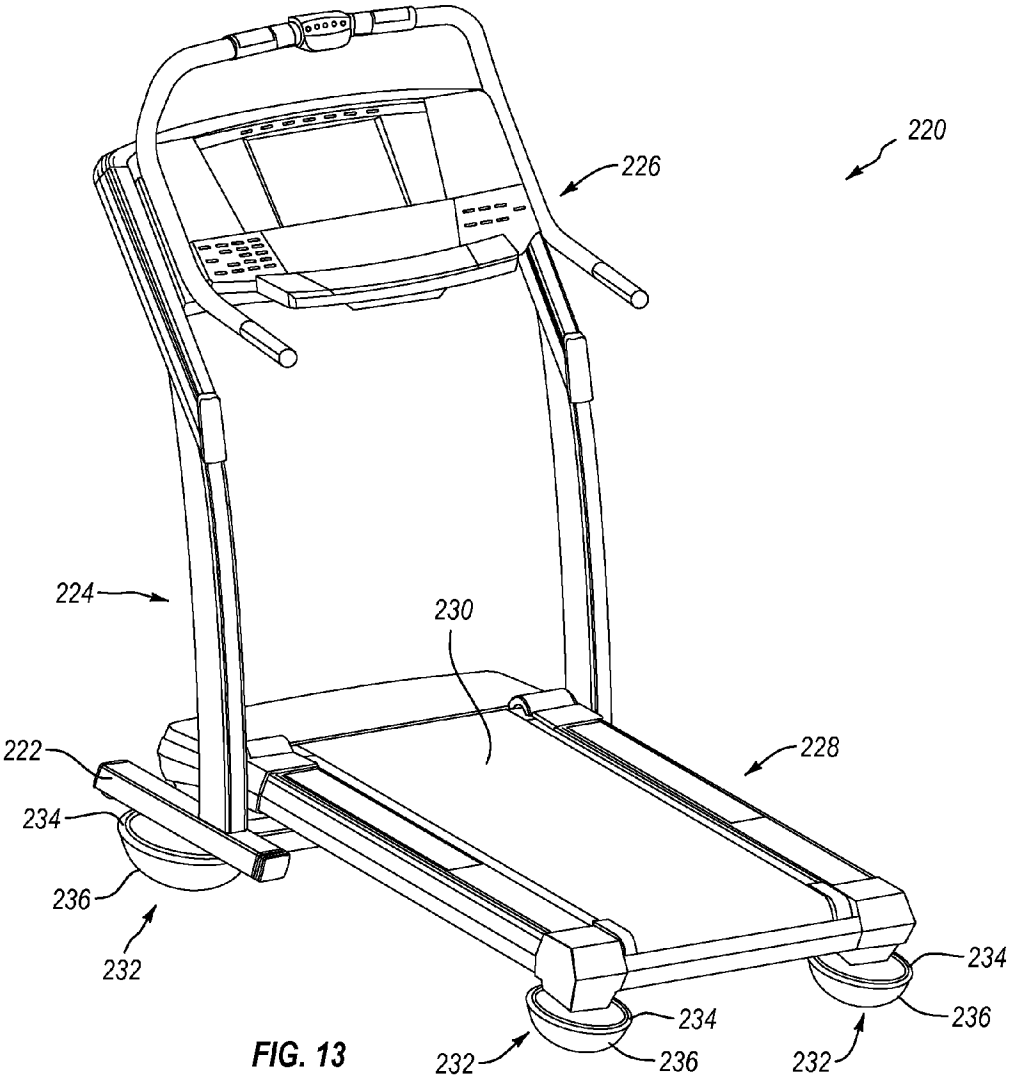
FIG. 13 illustrates a treadmill that has core strengthening devices incorporated therein.

Attention is now directed to FIG. 13, which illustrates an exercise device 220 in the form of a treadmill. Exercise device 220 includes a base support 222, a generally upright support structure 224 that supports a control panel 226, and a treadbase 228 connected to upright support structure 224. Treadbase 228 includes a rotatable belt 230 upon which a user may walk, jog, or run.

Exercise device 220 may also include one or more core strengthening devices 232 that are similar or identical to device 210. More specifically, exercise device 220 may include one or more devices 232 mounted under base support 222 and/or treadbase 228. Similar to the other core strengthening devices described herein, each of devices 232 may include a tray 234 and a ball 236. Like the other trays discussed herein, trays 234 may include recessed formed therein for receiving balls 236 partially therein. As shown, balls 236 extend out of trays 234 and engage a support surface. As a result, devices 232 provide some instability to exercise device 220 such that exercise device 220 can rock is various directions as a user walks, jogs, or runs thereon. As a result, the user's core muscles will have to work harder to maintain the user's balance, thereby improving the user's core strength.

In some embodiments, balls 236 may be removed from the recesses in trays 234 and trays 234 may be positioned directly on the support surface. By removing balls 236 from trays 234, exercise device 220 may be maintained in a relatively stable position. Thus, a user may select to have balls 236 positioned between exercise device 220 and the support surface to enhance a core muscle workout, or the user may select to remove balls 236 and have a more stable exercise device 220.

INDUSTRIAL APPLICABILITY

In general, embodiments of the present disclosure relate to systems and devices for improving a user's balance and core muscle strength. More particularly, the systems and devices provide some instability to exercises, which requires the user's muscles to work harder to maintain the user's balance. As a result of the increased work, the user's muscles are strengthened and the user's balance improves.

The systems and devices of the present disclosure may include one or more balls that have two hemispheres with different radii. The first hemisphere may have a shorter radius (and thus a greater curvature) than the second hemisphere. As a result of the different curvatures, the first and second hemispheres can provide different levels of instability to exercises being performed. For example, when the first hemisphere is positioned against a support surface and the user applies a force to the second hemisphere, either directly or through a tray associated with the ball, the greater curvature of the first hemisphere will allow the ball to roll or deform more than if the second hemisphere were positioned against the support surface. Accordingly, there will be more instability to the exercise, which will force the user's muscles to work harder.

In contrast, when the second hemisphere is positioned against a support surface and the user applies a force to the first hemisphere, either directly or through a tray associated with the ball, the lesser curvature of the second hemisphere will not allow the ball to roll or deform as much as if the first hemisphere were positioned against the support surface. Accordingly, there will be less instability to the exercise than when the first hemisphere is positioned against the support surface. Nevertheless, there will still be some instability to the exercise, which will work the user's muscles more than exercising on a completely stable surface.

In addition to the unique, dual hemisphered balls, the core strengthening devices and systems may include a tray. The tray may be designed for use with one or more of the dual hemisphered balls. For instance, the tray may include one or more recesses in which the one or more balls may be positioned. The one or more balls may be positioned in the one or more recesses with either the first or second hemisphere projecting therefrom. For instance, when it is desired to have a lower level of instability, the one or more balls may be positioned within the one or more recesses with the second hemispheres projecting out of the one or more recesses so as to engage a support surface. Alternatively, when it is desired to have a higher level of instability, the one or more balls may be positioned within the one or more recesses with the first hemispheres projecting out of the one or more recesses so as to engage the support surface.

In embodiments that include a tray with multiple recesses and multiple balls, the number of balls may be varied to provide different levels of instability. For example, a single ball may be used to provide tilt in both lateral directions and in the fore and aft directions. Alternatively, multiple balls may be used to reduce or eliminate instability in one or more directions. For instance, using two or more balls can reduce or eliminate instability or tilting in lateral direction while still allowing for fore and aft tilting/instability, or vice versa.

As noted, the devices and systems may include one or more balls and a tray with one or more recesses. In some embodiments, the system includes a tray with a single recess for receiving a single ball. In other embodiments, the system includes a tray with three recesses for receiving up to three balls. In other embodiments, the system may include a tray having any number of recesses for receiving any number of balls. Additionally, the recesses may be arranged on the tray in any of a variety of patterns. For instance, the recesses may be aligned with one another in a single row. Alternatively, the recesses may be arranged to form a geometric pattern or shape, such as a triangle, rectangle, circle, or the like. In embodiments where the system includes a tray with multiple recesses and multiple balls, one or more of the balls may be used while one or more of the balls may be set aside for certain exercises.

The core strengthening devices and systems may be incorporated into other exercise devices. For instance, a core strengthening device may be incorporated into a stationary exercise cycle. The core strengthening device may be disposed between an upright support member and a seat to provide some instability to the seat and allow the seat to rock. Similarly, one or more core strengthening devices may be utilized in connection with a treadmill or elliptical. For instance, one or more core strengthening devices may be positioned under the treadmill or elliptical to allow the treadmill or elliptical to rock or move during use.

What is claimed is:

1. A core strengthening device, comprising: a tray having a first side and an opposing second side, the first side having multiple recesses defined therein where the multiple recesses are closed with respect to the opposing second side; a ball selectively positionable at least partially within one of the multiple recesses in the tray, the ball having a first hemisphere and a second hemisphere, the first hemisphere having a first radius and the second hemisphere having a second radius that is different than the first radius; wherein one of the first hemisphere and second hemisphere have an apex and a height measured at the apex, wherein the height of the second hemisphere is about equal to a depth of the one of the multiple recesses; wherein the ball may be selectively inverted and positioned within the tray such that either the first hemisphere or the second hemisphere projects out of the one of the multiple recesses; and wherein the first hemisphere and the second hemisphere engage a center of the one of the multiple recesses in the tray differently.

2. The core strengthening device of claim 1, wherein the second side of the tray comprises a substantially flat surface.

3. The core strengthening device of claim 1, wherein the ball is selectively positionable within the one of the multiple recesses such that either the first hemisphere is positioned closer to the second side of the tray than the second hemisphere or the second hemisphere is positioned closer to the second side of the tray than the first hemisphere.

4. The core strengthening device of claim 1, wherein the first hemisphere comprises an outer surface having treads thereon; and wherein the second hemisphere includes frictional features configured to engage the one of the multiple recesses.

5. The core strengthening device of claim 1, wherein the core strengthening device is alternately usable in a first orientation and a second orientation, wherein, in the first orientation, the second side of the tray is positioned against a support surface and the ball projects out of the one of the multiple recesses away from the support surface; and wherein, in the second orientation, the second side of the tray faces away from the support surface and the ball projects out of the one of the multiple recesses toward the support surface.

6. The core strengthening device of claim 1, wherein the ball is usable to improve a user's core strength independent from the tray.

7. The core strengthening device of claim 1, wherein the tray comprises a first portion, a second portion, and a hinge connecting the first and second portions, wherein the hinge enables the tray to be selectively moved between a use configuration and a storage configuration.

8. The core strengthening device of claim 7, wherein the tray comprises a lock that selectively secures the tray in either the use configuration or the storage configuration.

9. The core strengthening device of claim 1, wherein the multiple recesses defined in the tray are generally aligned within a row.

10. The core strengthening device of claim 1, further comprising multiple balls selectively and respectively positionable at least partially within the multiple recesses of the tray.

11. The core strengthening device of claim 10, wherein one or more balls of the multiple balls has a first hemisphere and a second hemisphere, the first hemisphere having a first radius and the second hemisphere having a second radius that is different than the first radius.

12. A core strengthening device, comprising:

a tray having a first side and an opposing second side, the first side having a plurality of recesses defined therein where the plurality of recesses are closed with respect to the opposing second side; and a plurality of balls selectively and respectively positionable at least partially within the plurality of recesses in the tray, one or more balls of the plurality of balls having a first hemisphere and a second hemisphere, the first hemisphere having a first radius and the second hemisphere having a second radius that is different than the first radius;

wherein the one or more balls of the plurality of balls may be selectively inverted and positioned within the tray such that either the first hemisphere or the second hemisphere projects out of a respective one or more of the plurality of recesses.

13. The core strengthening device of claim 12, wherein the plurality of balls respectively project out of the plurality of recesses.

14. The core strengthening device of claim 12, wherein the plurality of recesses are generally aligned in a row.

15. A core strengthening device, comprising:

a tray, the tray having multiple recesses in a first side where the multiple recesses are closed with respect to an opposing second side of the tray;

a ball, the ball comprising:

a first hemisphere with an outer surface having a first radius; and a second hemisphere with an outer surface having a second radius, the second radius being greater than the first radius;

wherein one of the first hemisphere and second hemisphere have an apex and a height measured at the apex, wherein the height of the second hemisphere is about equal to a depth of one of the multiple recesses;

wherein the ball may be selectively inverted and positioned within the tray such that either the first hemisphere or the second hemisphere projects out of the one of the multiple recesses; and wherein the first hemisphere and the second hemisphere engage a center of the one of the multiple recesses in the tray differently.

16. The core strengthening device of claim 15, wherein the ball further comprises a first pole, a second pole, and an equator, wherein the equator is positioned closer to the second pole than the first pole.

* * * * *